US009115671B2

(12) United States Patent
Benoit

(10) Patent No.: US 9,115,671 B2
(45) Date of Patent: Aug. 25, 2015

(54) HYBRID CARBURETOR AND FUEL INJECTION ASSEMBLY FOR AN INTERNAL COMBUSTION ENGINE

(71) Applicant: Marvin V. Benoit, Alvaton, KY (US)

(72) Inventor: Marvin V. Benoit, Alvaton, KY (US)

(73) Assignee: Benebe, Inc., Alvaton, KY (US)

( * ) Notice: Subject to any disclaimer, the term of this patent is extended or adjusted under 35 U.S.C. 154(b) by 391 days.

(21) Appl. No.: 13/671,196

(22) Filed: Nov. 7, 2012

(65) Prior Publication Data

US 2014/0123944 A1 May 8, 2014

(51) Int. Cl.

| | |
|---|---|
| ***F02D 9/08*** | (2006.01) |
| ***F02M 61/14*** | (2006.01) |
| ***F02M 17/34*** | (2006.01) |
| ***F02M 19/08*** | (2006.01) |
| ***F02M 69/04*** | (2006.01) |

(52) U.S. Cl.

CPC ..... *F02M 17/34* (2013.01); *F02M 19/08* (2013.01); *F02M 69/044* (2013.01)

(58) Field of Classification Search

CPC ..... F02M 17/34; F02M 19/08; F02M 69/044; F02M 61/14; F02M 61/145

USPC ..... 123/337, 470

See application file for complete search history.

(56) References Cited

U.S. PATENT DOCUMENTS

| | | | | |
|---|---|---|---|---|
| 3,868,936 | A * | 3/1975 | Rivere | 123/445 |
| 3,931,369 | A | 1/1976 | Dale et al. | |
| 4,348,997 | A | 9/1982 | Takeda et al. | |
| 4,378,001 | A | 3/1983 | Takeda et al. | |
| 4,495,802 | A * | 1/1985 | Kashiwaya et al. | 73/114.32 |
| 4,517,837 | A * | 5/1985 | Oyama et al. | 73/202.5 |
| 4,770,131 | A * | 9/1988 | Tuckey | 123/73 A |
| 5,048,327 | A * | 9/1991 | Atwood | 73/114.33 |
| 5,672,187 | A * | 9/1997 | Rock et al. | 95/219 |
| 5,809,972 | A | 9/1998 | Grant | |
| 5,930,999 | A | 8/1999 | Howell et al. | |
| 6,290,215 | B1 | 9/2001 | Pinsker | |
| 7,634,983 | B2 * | 12/2009 | Grant | 123/184.31 |

OTHER PUBLICATIONS http://www.dunnva.com/images, "Holley 6425 Carburetor" Nov. 7, 2012.

* cited by examiner

*Primary Examiner* — Hai Huynh
(74) *Attorney, Agent, or Firm* — Dickinson Wright PLLC

(57) ABSTRACT

A hybrid fuel injection and carburetor assembly for delivering a fuel and air mixture into an intake manifold of an engine is provided. The assembly includes a housing and a plurality of inserts with Venturi-shaped bores to establish low pressure regions in the flow of air. The housing and inserts cooperate with one another to present cavities, and the inserts include apertures extending between the cavities and the low-pressure regions. The assembly also includes fuel injectors in fluid communication with the cavities. In operation, fuel is injected at a high pressure into the cavities to the point, and the pressurized fuel is delivered into the low pressure air via the apertures. Because of the large pressure difference between the pressurized fuel in the cavities and the low pressure air, the fuel becomes very atomized.

11 Claims, 3 Drawing Sheets

HYBRID CARBURETOR AND FUEL INJECTION ASSEMBLY FOR AN INTERNAL COMBUSTION ENGINE

BACKGROUND OF THE INVENTION

1. Field of the Invention

The present invention relates generally to a fuel injection assembly for delivering a fuel and air mixture into an intake manifold of an internal combustion engine and to a method of delivering a fuel and air mixture into an intake manifold of an internal combustion engine.

2. Related Art

Despite the ubiquitous use of fuel injection, carburetors remain in use in many internal combustion engines. Generally, carburetors include at least one Venturi-shaped barrel, throttle valve and float bowl. In operation, a vacuum is drawn by a piston, which pulls air through the Venturi-shaped barrel and an intake manifold and ultimately to a combustion chamber. A low pressure region in the Venturi-shaped barrel pulls fuel out of the float bowl to atomize the fuel into the flow of air. In contrast, in most fuel injected engines, a fuel injector propels fuel either into the air just upstream of each cylinders' intake valve or directly into the combustion chamber. As one of ordinary skill in the art will appreciate, it is very costly to convert a carbureted engine to fuel injection using conventional processes because certain components of the engine must be modified or replaced in order to accommodate the fuel injectors.

Some engine manufacturers have developed hybrid carburetor fuel injector assemblies that can be used with carbureted engines. Such hybrid assemblies typically include one or more fuel injectors which are configured to propel fuel directly into a flow of air flowing through a Venturi-shaped barrel. However, such hybrid assemblies are often very costly to manufacture and may not provide sufficient atomization of the fuel into the flow of air.

SUMMARY OF THE INVENTION

According to one aspect of the present invention, a hybrid fuel injection and carburetor assembly for delivering a fuel and air mixture into an intake manifold of an internal combustion engine is provided. The fuel injection assembly includes a housing having at least one bore that extends along an axis for conveying a flow of air. Each bore is generally Venturi-shaped, i.e. each bore has a narrow area disposed between two wider areas to establish a low pressure region in the flow of air. At least one valve is pivotably attached to the housing for selectively controlling the flow air through the bore(s). The housing presents a cavity and at least one aperture that extends between the cavity and the low-pressure region of the Venturi-shaped bore. At least one fuel injector is also in fluid communication with the at least one cavity for delivering fuel into the at least one cavity. In operation, fuel is injected by the fuel injectors into the cavity to the point where the fuel is pressurized within the cavity. The pressurized fuel is then delivered into the low pressure air in the low-pressure region of the Venturi-shaped bore via the at least one aperture. Because of the large pressure difference between the pressurized fuel in the cavity and the low pressure flow of air, the fuel becomes more atomized in the flow of air than other known hybrid assemblies. As such, a fuel and air mixture is created that burns more efficiently than the fuel and air mixtures created by other known hybrid assemblies. The hybrid assembly of this aspect of the invention is also advantageous because it can be coupled with an engine otherwise designed for a carburetor without the extensive modifications that would otherwise be required to convert the engine for conventional fuel injection systems.

According to another aspect of the invention, the housing presents a shoulder in the narrow area of each bore, and each shoulder faces downstream. The aperture between the high pressure cavity and each bore extend to a location adjacent to and downstream of the shoulder. In operation, each shoulder generates turbulence in the air flowing through the associated bore, and the fuel is delivered into this turbulent and low pressure region. This has the effect of further atomizing the fuel in the flow of air.

According to yet another aspect of the present invention, the housing of the hybrid fuel injection and carburetor assembly is of two pieces. Specifically, the housing includes a body portion and at least one insert disposed in the body portion and presenting the Venturi-shaped bore(s) with the above-discussed shoulders. The body portion and the insert cooperate with one another to present the high pressure cavity. Specifically, at least one of the inner surface of the body portion and the outer surface of the insert presents a groove, and the high pressure cavity is defined by the gap between the body portion and the insert at the location of the groove. This aspect is advantageous as it allows for creation of the high pressure cavity very inexpensively, i.e. without having to drill or otherwise form an interior passage. Additionally, different inserts could be used with the same body portion to give the fuel injection assembly different performance, i.e. the performance of the fuel injection assembly can be modified through simply removing insert and adding a different insert with a differently-shaped groove. As such, the hybrid assembly according to this aspect of the present invention is modular.

According to still another aspect of the invention, the groove on the insert and/or the body portion extends entirely around the outer surface of the insert, and the insert includes a plurality of apertures spaced circumferentially from one another. Preferably, the apertures are generally uniformly circumferentially spaced from one another. This gives the high pressure cavity a generally annular shape and the fuel is delivered from the high pressure cavity generally uniformly around the Venturi-shaped bore to more uniformly distribute the fuel into the flow of air.

BRIEF DESCRIPTION OF THE DRAWINGS

These and other features and advantages of the present invention will be readily appreciated, as the same becomes better understood by reference to the following detailed description when considered in connection with the accompanying drawings wherein.

DESCRIPTION OF THE ENABLING EMBODIMENT

Figure 1:
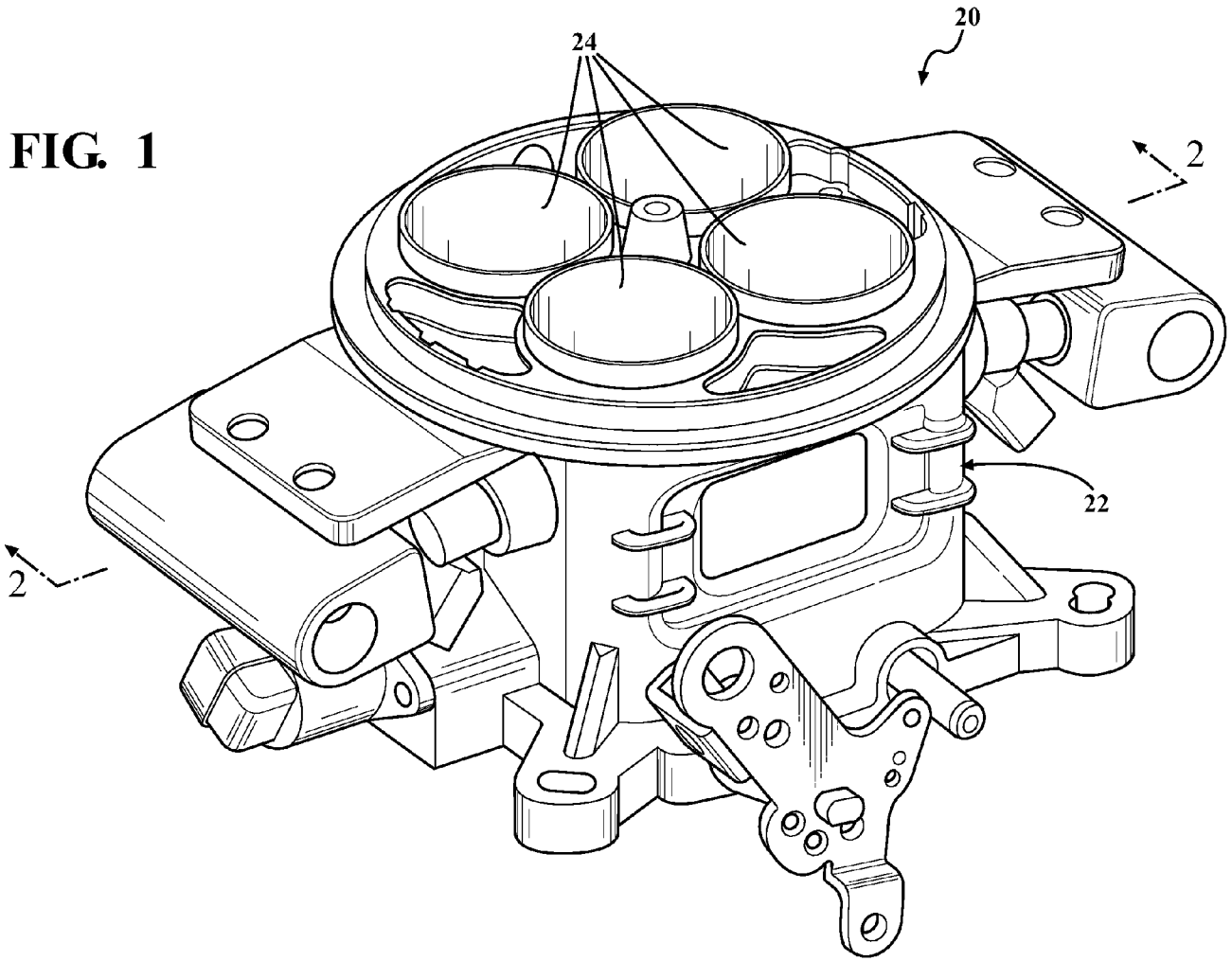
FIG. 1 is a perspective view of an exemplary hybrid carburetor and fuel injector assembly.

Referring to the Figures, wherein like numerals indicate corresponding parts throughout the several views, an exemplary hybrid carburetor and fuel injector assembly 20 for delivering a fuel and air mixture into an intake manifold (not shown) of an internal combustion engine (not shown) is generally shown in FIG. 1. The exemplary fuel injection assembly 20 may be used with a wide range of different types of internal combustion engines for any type of vehicle including automobiles and boats and is preferably packaged and sold as an aftermarket product to be mounted on an existing engine. Of course, the exemplary fuel injector assembly 20 could alternately be packaged and sold in conjunction with the engine.

Figure 2:
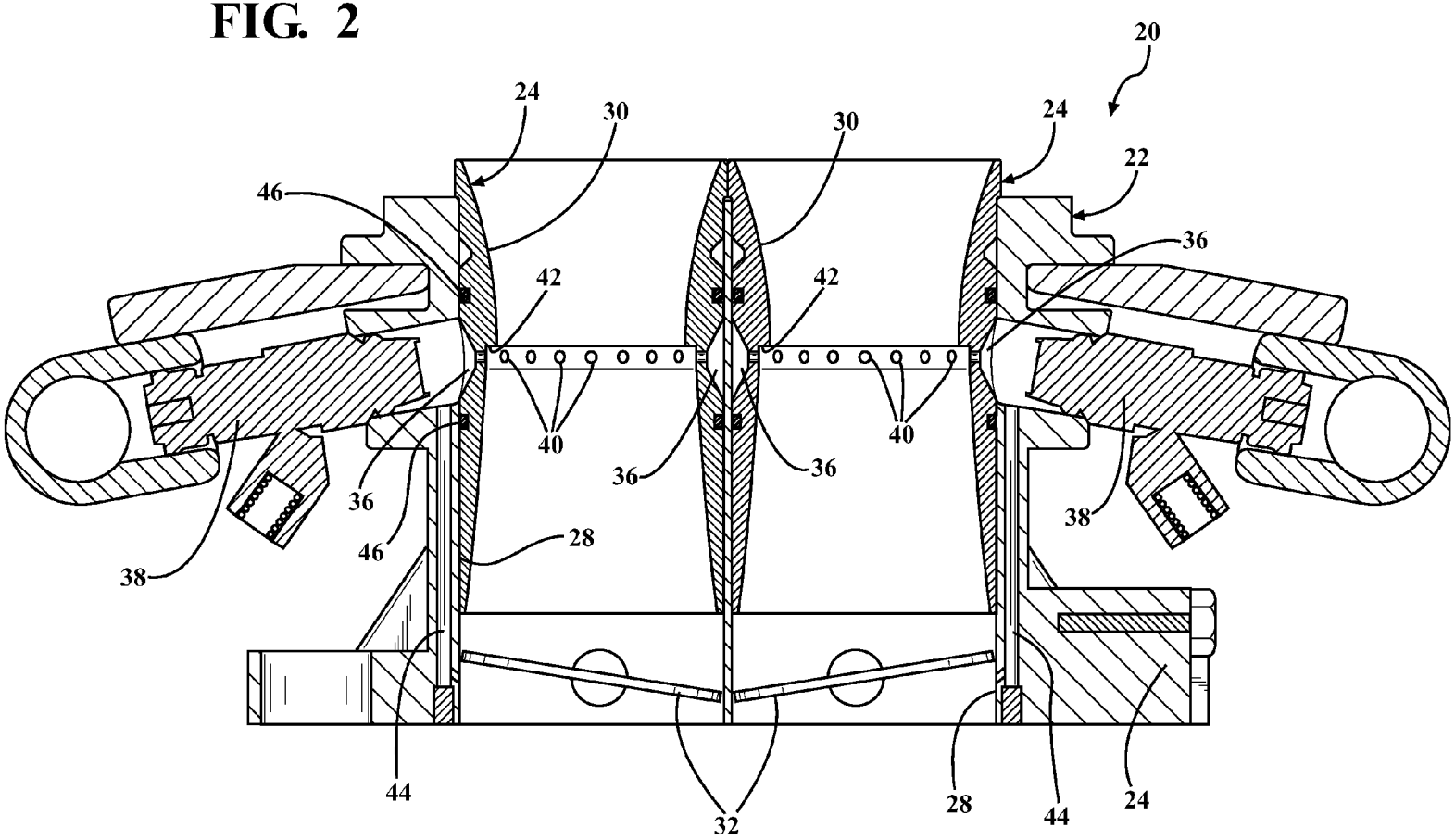
FIG. 2 is a cross-sectional view of the exemplary hybrid assembly taken along line 2-2 of FIG. 1.

Referring now to the cross-sectional view of FIG. 2, the exemplary fuel injection assembly 20 includes a housing 22 having a body portion 24 and a plurality of inserts 26. The housing 22 portion includes four generally cylindrically-shaped bores 28 spaced from one another, and the inserts 26 are disposed in the cylindrical bores 28. Each of the inserts 26 presents a Venturi-shaped barrel 30 with a wide intake end for receiving a flow of air, a wide outlet end and a narrow area between the wider ends. As with conventional carburetors this provides for a low-pressure region adjacent the narrow area in the flow of air passing through the Venturi-shaped barrels 30. As such, the narrow area of each Venturi-shaped barrel 30 will hereinafter be referred to as a "low pressure region". It should be appreciated that the hybrid assembly 20 could include any desirable number of bores 28 and inserts 26. The body portion 24 of the housing 22 is preferably formed of metal (e.g. steel or aluminum) and shaped through a casting process, and the inserts 26 are preferably formed of a polymeric material and shaped with an injection molding process. As is common with conventional carburetors, a throttle valve 32 is disposed in each of the bores 28 adjacent the ends of the Venturi-shaped barrels 30 for selectively controlling the volume of the flow of air through the barrels 30.

Figure 3:
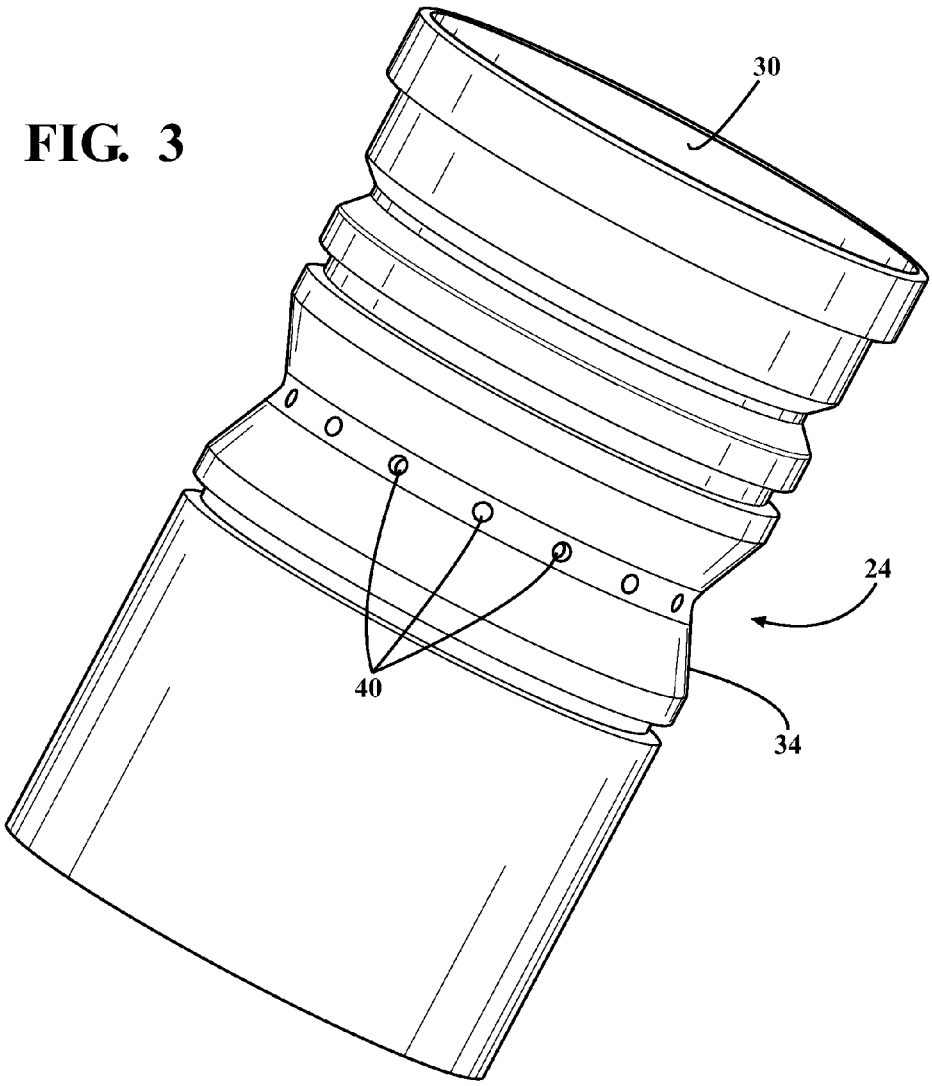
FIG. 3 is a perspective view of an exemplary insert.

Referring now to FIG. 3, each of the inserts 26 includes an outer surface with a groove 34 positioned axially between the ends and preferably in axial alignment with the narrow area or low pressure region of the Venturi-shaped barrel 30. The grooves 34 extend around the perimeter of the insert 26. Referring back to the cross-sectional view of FIG. 2, the grooves 34 of the inserts 26 cooperate with the housing 22 to present a plurality of generally annularly-shaped cavities 36 (see FIG. 2). It should be appreciated that the grooves could alternately extend less than entirely around the insert or could even be formed into the bores of the housing in addition to or alternatively of the inserts.

As shown in FIG. 2, the exemplary hybrid assembly 20 additionally includes a fuel injector 38 associated with each of the inserts 24 and attached to the housing 22. Referring to the cross-sectional view of FIG. 2, each of the fuel injectors 38 is in fluid communication with one of the annularly-shaped cavities 36 for delivering a high-pressured flow of fuel into its respective cavity 36. As such, the cavities 36 are hereinafter referred to as "high pressure cavities 36". Each of the exemplary inserts 26 includes a plurality of apertures 40 which extend from the grooves 34 to the narrow areas of the Venturi-shaped barrels 30. As such, during operation of the hybrid assembly 20 a high pressure flow of fuel is delivered from the high pressure cavity 36 into the low pressure regions of the air flowing through the Venturi-shaped barrels 30. Because of the great pressure difference between the fuel in the high pressure cavities 36 and the flow of air in the low pressure regions of the Venturi-shaped barrels 30, the fuel atomizes in the air extremely quickly and efficiently. This leads to a more uniform and efficient combustion of the fuel and air mixture in the combustion chamber of the internal combustion engine. The cumulative cross-sectional areas of the apertures 40 of each insert 26 is preferably smaller than the outlet of the associated fuel injector 38 to enhance the pressurization of the fuel in the high pressure cavities 36.

As shown in FIG. 3, the apertures 40 for delivering the high pressure fuel into the low pressure flow of air are generally uniformly spaced from one another around the circumference of each insert 26. As such, the fuel from the annularly-shaped high pressure cavities 36 is generally uniformly delivered into the flow of air around the perimeter of the Venturi-shaped barrel 30 to create a more uniform air and fuel mixture. It should be appreciated that the inserts 26 could include any desirable number of apertures 40 and the apertures 40 could be variably spaced from one another. The apertures 40 could also be either generally uniformly sized or could have varying sizes.

Referring back to the cross-sectional view of FIG. 2, the inner surface of each of the inserts 26 presents a shoulder 42 which is disposed in the narrow area and faces towards the outlet end of the hybrid assembly 20. The apertures 40 of the exemplary insert 26 extend into the Venturi-shaped barrel 30 adjacent and downstream of the shoulder 42. In operation, the shoulder 42 creates turbulence in the air flowing through the Venturi-shaped barrels 30. As such, the high pressure fuel is delivered into the turbulent and low pressure air flowing through the barrels 30 to even further atomize the fuel into the flow of the air.

The housing 22 additionally includes a plurality of idle paths 44 which extend downwardly from the high pressure cavities 36 to openings below the throttle valves 32 for delivering a flow of fuel into the intake manifold during idling of the internal combustion engine. Specifically because the throttle valves 32 are closed (or substantially entirely closed) during idling, the pressure of the air below the throttle valves 32 is typically lower than above the throttle valves 32 and the fuel is drawn through the idle paths 44 rather than through the apertures 40 of the insert 26. In contrast, when the throttle valves 32 are open, the pressure of the flow of air through the low pressure region of the Venturi-shaped barrels 30 is typically lower than the pressure of the air below the throttle valves 32, and therefore little (if any) fuel travels through the idle paths 44 during non-idling operation of the engine.

As also shown in FIG. 2, the outer surfaces of the exemplary inserts 26 include a pair of seal grooves spaced axially on either side of the channel, and a seal 46 is disposed in each of the seal grooves for sealing the respective inserts 26 to the housing 22. As such, fuel in the high pressure cavities 36 can only escape the high pressure cavities 36 through the apertures 40 in the inserts 26 or through the idle paths 44 of the housing 22 body. The seals 46 could be O-rings or any desirable types of seals 46.

Obviously, many modifications and variations of the present invention are possible in light of the above teachings and may be practiced otherwise than as specifically described while within the scope of the appended claims.

What is claimed is:

1. A fuel injection assembly for delivering a fuel and air mixture into an intake manifold of an internal combustion engine, comprising:

a housing including a plurality of bores each extending in an axial direction from an intake end for receiving a flow of air and an outlet end for delivering the flow of air into the intake manifold of the engine;

a throttle valve disposed in each of said bores adjacent said outlet ends and pivotably connected to said housing for selectively controlling the flow of air through each of said bores;

an insert disposed in each of said bores axially between said intake end and said throttle valve;

each of said inserts having an outer surface and a venturi-shaped inner surface that is wide at each of its ends and has narrow region between said ends to define a low pressure region for the flow of air through said bores of said housing;

said outer surface of each of said inserts presenting an annularly shaped channel aligned axially with said narrow region of said inner surface to present an annularly-shaped cavity which is defined at least partially by both said outer surface of said insert and said housing;

a plurality of fuel injectors attached to said housing and in fluid communication with said annularly-shaped cavities to deliver a high-pressured flow of fuel into said cavities;

each of said inserts including a plurality of apertures circumferentially spaced from one another for conveying the fuel from said high-pressured cavities into said low pressure region of the flow of air;

said inner surface of each of said inserts further defining a shoulder facing towards said outlet and disposed axially in said narrow region to present a turbulent region for the flow of air flowing through each of said bores, and wherein said plurality of apertures of said inserts are disposed adjacent to said ledge for delivering the high pressure fuel into said turbulent and low pressure region;

said housing presenting a plurality of idle paths extending from said fuel injectors to a location downstream of said throttle valves for delivering a flow of fuel into the intake manifold during idling of the internal combustion engine; and said outer surfaces of said inserts including at least one groove spaced axially on either side of said channel and a seal disposed in each of said grooves for sealing said inserts to said housing.

2. A fuel injection assembly for delivering a fuel and air mixture into an intake manifold of an internal combustion engine, comprising:

a housing with at least one bore extending along an axis;

an insert disposed in said bore of said housing for conveying a flow of air into the intake manifold, and wherein said at least one bore has a venturi shape that is wide at its ends and has a narrow area between said ends to present a low pressure region for the flow of air;

at least one valve pivotably attached to said housing for selectively controlling the flow of air through said at least one bore;

at least one fuel injector attached to said housing for delivering a fuel into the flow of air;

said housing presenting a high pressure cavity in fluid communication with said fuel injector for receiving the fuel and presenting at least one aperture extending between said high-pressure cavity and said low pressure region of said bore for delivering a high pressure injection of fuel into the low pressure flow of air at said narrow region of said at least one bore; and wherein said high pressure cavity is defined at least partially by a groove in an outer surface of said insert and by said housing.

3. The fuel injection assembly as set forth in claim 2 wherein said housing presents a shoulder in said narrow area of said at least one bore, wherein said shoulder faces downstream to give the flow of air turbulence in said low pressure region and wherein said at least one aperture extends to a location adjacent and downstream of said shoulder to deliver the fuel into said turbulent and low pressure region of said at least one bore.

4. The fuel injection assembly as set forth in claim 2 wherein said insert has an outer surface with a groove extending at least partially its circumference and wherein said housing and said groove of said insert cooperate to present said high pressure cavity.

5. The fuel injection assembly as set forth in claim 4 wherein said groove extends around the entirety of said outer surface such that said high pressure cavity has a generally annular shape.

6. The fuel injection assembly as set forth in claim 5 wherein said at least one aperture for delivering the high pressure fuel to said low pressure and turbulent region of said at least one bore is further defined as a plurality of apertures spaced circumferentially from one another around said annularly shaped high pressure cavity.

7. The fuel injection assembly as set forth in claim 6 wherein said plurality of apertures are spaced generally uniformly from one another around said annularly-shaped high pressure cavity to generally uniformly deliver fuel into said turbulent and low pressure region of said bore.

8. A method of delivering a fuel and air mixture into an intake manifold of an internal combustion engine, comprising the steps of:

providing a housing with at least one bore and an insert disposed in said bore, said insert having an inner surface which has a venturi-shape with a narrow area between wider ends;

drawing a flow of air through the at least one bore such that the flow of air is at a lower pressure when flowing through the narrow area of the bore than when flowing through the wider areas of the bore;

injecting with at least one fuel injector a fuel into a high pressure cavity defined at least partially by each of the housing and a groove in an outer surface of the insert; and delivering the fuel from the high pressure cavity into the low pressure air flowing through the narrow area of the at least one bore.

9. The method as set forth in claim 8 further including the step of turbulating the flow of air in the low pressure region, and wherein the step of delivering the fuel into the at least one bore is further defined as delivering the fuel from the high pressure cavity into the turbulent and low pressure area of the at least one bore.

10. The method as set forth in claim 8 wherein the step of delivering the fuel into the at least one bore is further defined as delivering the fuel into the low pressure air flowing through the narrow area of the at least one bore generally uniformly around the narrow area of the at least one bore.

11. The method as set forth in claim 8 further including the step of removing the at least one insert from the body portion and inserting a different insert having at least one of a differently shaped bore and a differently shaped cavity.

* * * * *